US011773561B2

(12) United States Patent
Liu et al.

(10) Patent No.: US 11,773,561 B2
(45) Date of Patent: Oct. 3, 2023

(54) COMBINED SUCTION ANCHOR REINFORCED BY GROUTING SPIRAL ANCHOR

(71) Applicant: ZHEJIANG UNIVERSITY, Hangzhou (CN)

(72) Inventors: Junwei Liu, Hangzhou (CN); Shengjie Rui, Hangzhou (CN); Haojie Zhang, Hangzhou (CN); Yujie Li, Hangzhou (CN); Yuzhe Dou, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 57 days.

(21) Appl. No.: 16/766,283

(22) PCT Filed: Oct. 11, 2019

(86) PCT No.: PCT/CN2019/110651
§ 371 (c)(1),
(2) Date: Jul. 17, 2020

(87) PCT Pub. No.: WO2020/237965
PCT Pub. Date: Dec. 3, 2020

(65) Prior Publication Data

US 2022/0275597 A1 Sep. 1, 2022

(30) Foreign Application Priority Data

May 29, 2019 (CN) ..... 201910458395.2

(51) Int. Cl.
*E02D 27/52* (2006.01)
*E02D 5/32* (2006.01)
*E02D 5/80* (2006.01)

(52) U.S. Cl.
CPC ..... *E02D 27/525* (2013.01); *E02D 5/32* (2013.01); *E02D 5/801* (2013.01); *E02D 5/808* (2013.01);
(Continued)

(58) Field of Classification Search
CPC ..... E02D 27/525; E02D 2250/0053; F03D 13/22
See application file for complete search history.

(56) References Cited

U.S. PATENT DOCUMENTS 6,457,908 B1 10/2002 Bergeron
9,096,985 B1 * 8/2015 Phuly ..... E04H 12/341
(Continued)

FOREIGN PATENT DOCUMENTS

CN 201901242 U 7/2011
CN 202124862 U 1/2012
(Continued)

OTHER PUBLICATIONS

CN First Office Action (201910458395.2); dated Jan. 22, 2020.
International Search Report (PCT/CN2019/110651); dated Feb. 26, 2020.

*Primary Examiner* — Kyle Armstrong
(74) *Attorney, Agent, or Firm* — W&G Law Group

(57) ABSTRACT

Provided is a combined suction anchor reinforced by a grouting spiral anchor, including a gravity suction anchor, an L-shaped skirt board and a spiral anchor. The gravity suction anchor includes a suction anchor top plate and a wall of a suction anchor barrel body and uses a concrete press block to reach an estimated set position faster during penetration due to self-weight thereof. Thereafter, the skirt board is lifted to outside of the suction anchor through a lug, and a fixing bolt is used to connect the skirt board to the suction anchor. The spiral anchor rod passes through a skirt board hole performed in the skirt board to penetrate into a deep site of seabed, and concrete is grouted through the skirt board
(Continued)

hole to a seabed soil area loosened due to penetration of the spiral anchor rod, thereby forming a concrete reinforced area after the concrete solidifies.

7 Claims, 5 Drawing Sheets

(52) U.S. Cl.
CPC .. *E02D 2250/0053* (2013.01); *E02D 2600/30* (2013.01)

(56) References Cited

U.S. PATENT DOCUMENTS

| | | | | |
|---|---|---|---|---|
| 2017/0058474 | A1* | 3/2017 | Haigh | E02D 7/20 |
| 2022/0195686 | A1* | 6/2022 | Bartminn | E02D 27/425 |
| 2022/0316170 | A1* | 10/2022 | Olsen | F16L 1/16 |

FOREIGN PATENT DOCUMENTS

| | | | | |
|---|---|---|---|---|
| CN | 205152951 | U | | 4/2016 |
| CN | 106759200 | A | | 5/2017 |
| CN | 206815361 | U | | 12/2017 |
| CN | 206873486 | U | | 1/2018 |
| CN | 108086347 | A | | 5/2018 |
| CN | 208685648 | U | | 4/2019 |
| CN | 110172998 | A | | 8/2019 |
| GB | 2277547 | B | | 8/1996 |
| KR | 20130094410 | A | * | 8/2013 |
| KR | 20160139283 | A | * | 12/2016 |
| WO | 2018117862 | A1 | | 6/2018 |

* cited by examiner

COMBINED SUCTION ANCHOR REINFORCED BY GROUTING SPIRAL ANCHOR

TECHNICAL FIELD

The present disclosure relates to a combined suction anchor, and in particular, to a combined suction anchor reinforced by a grouting spiral anchor.

BACKGROUND

With the increasing shortage of global energy sources, development and utilization of new energy sources has received extensive attention from all countries in the world. Among them, marine wind energy, as a new type of pollution-free and renewable green energy, is of great significance to sustainable development of the global society. Therefore, offshore wind power has been developed rapidly, and suction anchors, as a basic form of the ocean, have characteristics of adapting to a variety of marine environments.

The suction anchor has characteristics of simple construction, safety, reliability and reusability, and it has better economic characteristics compared with traditional structural piles, gravity anchors and chain anchors. However, in actual engineering, the suction anchors often fail when they are subjected to large vertical pulling forces and horizontal forces. Therefore, improvement of the suction anchors has also been engaged by scholars for a long time.

Current situations of related research are as follows.

(1) A Chinese patent with an application number 201810382104 provides a deep-sea inner-ring submarine suction anchor and an installation method thereof, in which the suction anchor includes a suction main barrel formed as a barrel-shaped structure with an open bottom and a closed top, an inner wall of the suction main barrel is provided with a plurality of hollow annular protrusions spaced from each other by a same distance in an axial direction, the inner wall of the suction main barrel and a side wall of the hollow annular protrusion forms a barb-shaped structure, and drainage holes are provided at a top center and a top edge of the suction main barrel. However, this patent does not substantially improve an anti-overturning bearing capacity of the suction anchor.

(2) A Chinese patent with an application number 201820207173.4 provides an anti-soil-plugging suction anchor, which includes a main body of the suction anchor, and side wing barrels are evenly distributed around a side wall of the main body of the suction anchor. However, in this patent, the main barrel being connected to a plurality of side barrels as a whole causes bad integrity, thereby making it difficult to exert the bearing capacity as a whole.

(3) A Chinese patent with an application number 201820206382.7 provides a new type of suction anchor, which includes an anchor barrel shell, a top plate, and a negative pressure pump interface, and an arc plate is used to allow three anchor barrels to be formed as an integrity, so as to improve the anti-pulling bearing capacity of the suction anchor. However, this patent does not improve the anti-overturning bearing capacity.

(4) A Chinese patent with an application number 201711253347.7 provides a suction-type barrel foundation that can rotatably penetrate downwardly, and it includes an anchor barrel having a closed top surface and an open lower end, and a rotating power barrel at a top end of the anchor barrel. This patent significantly reduces downward-penetration resistance of the suction anchor, but for this patent, it is difficult to be installed, and a bearing capacity of the soil is reduced due to excessive disturbance to the soil caused by rotating installation.

(5) A Chinese patent with an application number 201711253348.1 provides a hollow thread suction anchor that can self-rotate to penetrate downwardly, and it includes an anchor barrel having a closed top surface and an open lower end, a top end of the anchor barrel is provided with a drainage hole connected to a submersible pump I, and combination of suction and rotation reduces the downward-penetration resistance and improves an installation efficiency. However, this patent failed to increase the anti-overturning bearing capacity of the suction anchor when an anchor chain is pulled diagonally upwards.

(6) A Chinese patent with an application number 201720217185.0 provides a new type of submarine skirt suction anchor, and it includes a suction main barrel, a double-skirt structure and an annular groove that have a same central axis. The double-skirt structure is a cylindrical structure with double skirts, namely an outer skirt and an inner skirt, surrounding the suction main barrel. However, the skirt structure of this patent has little effect on the bearing capacity.

SUMMARY

In view of the defects in the related art, the present disclosure proposes a combined suction anchor reinforced by a grouting spiral anchor. The combined suction anchor uses a high-strength bolt to combine a grouting spiral anchor and a skirting anchor with a gravity suction anchor after an installation process of a traditional suction anchor is completed, thereby greatly improving overall vertical, horizontal and anti-overturning bearing capacities of the suction anchor, and improving safety performance and engineering usage performance of the suction anchor.

The present disclosure adopts following technical solutions.

A combined suction anchor reinforced by a grouting spiral anchor is provided, and the combined suction anchor includes a gravity suction anchor, an L-shaped skirt board and a spiral anchor/

The gravity suction anchor is closed at an upper end and open at a lower end and includes a suction anchor top plate and a wall of a suction anchor barrel body, a groove is formed between the wall of the suction anchor barrel body and the suction anchor top plate, and a concrete press block is provided in the groove. The concrete press block is configured to make the suction anchor reach an estimated set position faster during a penetration stage due to self-weight of the suction anchor. The suction anchor top plate is further provided with a suction anchor negative pressure hole, and a suction anchor eye is provided at an upper end of the suction anchor negative pressure hole.

The L-shaped skirt board has an annular shape and is provided with skirt board lugs that are symmetrically arranged at an upper part of the L-shaped skirt board, the L-shaped skirt board can be lifted to outside of the suction anchor by the skirt board lugs to be connected to the suction anchor, and a plurality of rows of skirting anchors are provided at a lower part of the L-shaped skirt board, so as to improve a horizontal bearing capacity and an anti-pulling bearing capacity of the suction anchor.

The spiral anchor includes a spiral anchor rod and an anti-rotation plate provided at a top end of the spiral anchor rod, the spiral anchor rod is vertically and rotatably installed into a deep site of seabed through a skirt board hole formed in the L-shaped skirt board, until the anti-rotation plate contacts the L-shaped skirt board, and concrete is grouted through the skirt board hole to a seabed soil area loosened due to penetration of the spiral anchor rod, thereby forming a high-strength concrete anti-pulling area after the concrete solidifies. The gravity suction anchor, the spiral anchor rod and the skirting anchor together provide a vertical beating capacity, a horizontal bearing capacity and an anti-overturning bearing capacity.

In the above technical solution, preferably, the suction anchor top plate is further provided with a lug, a vertical channel is provided above the lug, and during the installation process, a steel cable hanging the lug vertically passes through the vertical channel to ensure that the suction anchor is always kept vertical during the installation process.

Preferably, the suction anchor and the L-shaped skirt board are fixedly connected to each other by a high-strength bolt (a bolt performance grade being greater than or equal to a grade of 9.8), thereby improving a vertical bearing capacity and a lateral anti-overturning capacity of the overall suction anchor.

Preferably, an anti-scouring slope is provided at an end of the L-shaped skirt board to prevent the suction anchor from being subjected to an excessive lateral force during operation.

Preferably, four connectors for the suction anchor top plate and the suction anchor barrel body are provided, and are evenly distributed in a circumferential direction of the suction anchor and located below the lug.

Preferably, the concrete press block is formed by pouring after an entire installation process of the suction anchor top plate and the wall of the suction anchor barrel body are completed, and is configured to allow the suction anchor to reach a specified position faster during penetration of the suction anchor due to self-weight thereof.

Preferably, eight spiral anchors are provides, and the eight spiral anchors are evenly distributed along a circumferential direction of the L-shaped skirt board.

An entire installation process of the suction anchor device of the device of the present disclosure is divided into three stages: a first stage, in which the gravity suction anchor device is installed to a specified depth due to self-weight and suction of the suction anchor; a second stage, in which the L-shaped skirt board is fixed and connected to the suction anchor by a bolt; and a third stage, in which the spiral anchor rod is installed and grouting-fixed to form an anti-pulling reinforced area. The installation process includes following steps.

(1) In the first stage of the installation process of the suction anchor, penetration installation is carried out due to self-weight of the suction anchor and the concrete press block. Then, a negative pressure is applied through a suction anchor negative pressure hole until the suction anchor reaches a specified installation position. Meanwhile, the concrete press block can play a role of anti-pulling when the suction anchor is subjected to a vertical pulling force, thereby improving the safety performance of the suction anchor during use.

(2) In the second stage of the installation process of the suction anchor, the annular L-shaped skirt board movably installed by the skirt board lug is sleeved on outside of the barrel body of the suction anchor and covers a surface of the seabed. Thereafter, the high-strength bolt is used to make the suction anchor be connected and fixed to the annular L-shaped skirt board.

(3) In the third stage of the installation process of the suction anchor, the spiral anchor rod is vertically and rotatably installed through the preformed skirt board hole to penetrate into the seabed soil, until an anti-rotation plate contacts an anchor plate. Then the concrete is grouted through the skirt board hole to gradually fill an entire grouting area, and the concrete forms a concrete reinforced area in the soil where crack is formed due to penetration of the anchor rod, greatly improving the overall anti-pulling bearing capacity of the suction anchor. In addition, the spiral anchor rod and the L-shaped skirt board are connected to each other to form an integrity by consolidation of the concrete poured through the skirt board hole.

The present disclosure has following advantages.

1. In the device of the present disclosure, a concrete press block is additionally provided at an upper part of the suction anchor, thereby ensuring that the suction anchor can penetrate into an interior of the seabed faster during the past penetration process due to self-weight of the suction anchor.
2. In the device of the present disclosure, the L-shaped skirt board and the suction anchor are fixedly connected to each other to form an integrity by the high-strength bolt, together bearing an external force. When a horizontal external force is applied in the present disclosure, deflection is less likely to occur.
3. In the device of the present disclosure, concrete is poured into an area where the spiral anchor rod is inserted to form a reinforced area, and the reinforced area can significantly improve the anti-pulling bearing capacity of the suction anchor.

Figure 1:
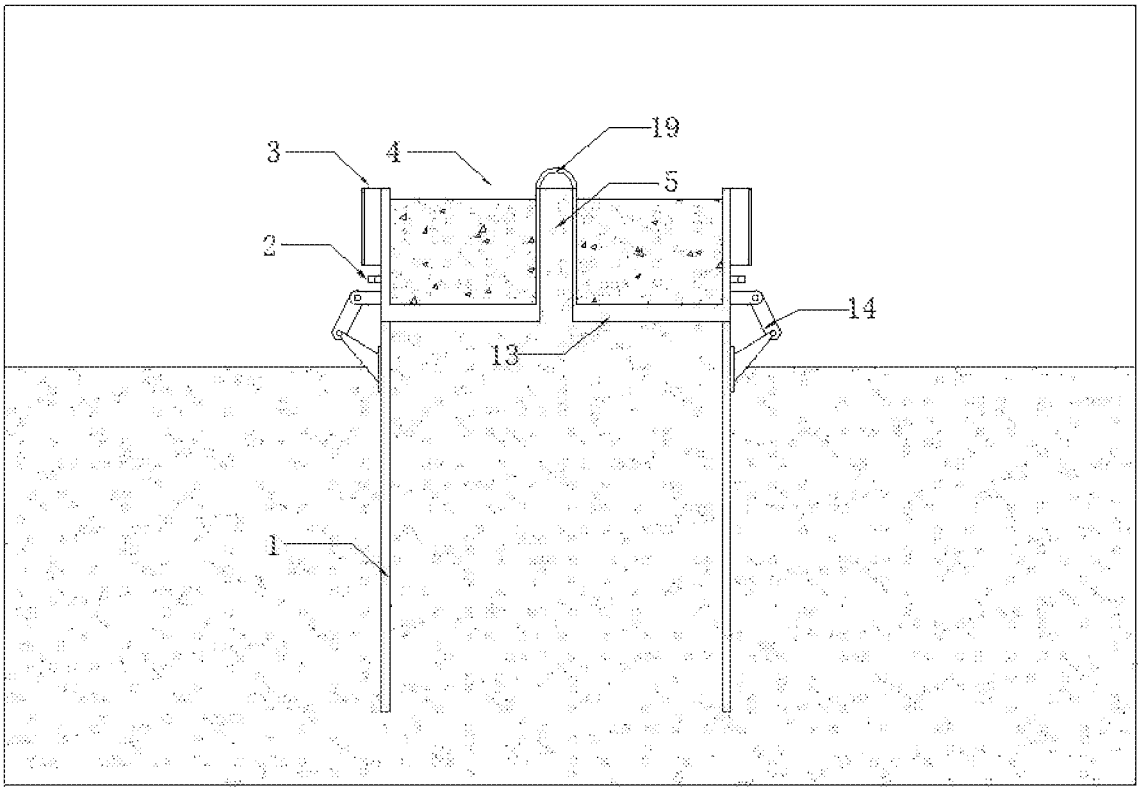
FIG. 1 illustrates a first stage of an installation process of a combined suction anchor of the present disclosure.

In the figures, 1 is a wall of a suction anchor barrel body, 2 is a lug, 3 is a vertical channel; 4 is a concrete press block; 5 is a suction anchor negative pressure hole, 6 is a L-shaped skirt board, 7 is a skirt board hole, 8 is a high-strength bolt, 9 is a concrete reinforced area, 10 is a spiral anchor, 11 is an anti-rotation plate, 12 is a spiral anchor rod, 13 is a suction anchor top plate, 14 is a connector for the suction anchor top plate and the suction anchor barrel body, 15 is a skirting anchor, 16 is anti-scouring slope, 17 is a skirt board lug, 18 is a grouting fixing hole, and 19 is a suction anchor eye.

DESCRIPTION OF EMBODIMENTS

The technical solutions of the present disclosure will be further described in the following in conjunction with the embodiments and drawings.

A combined suction anchor reinforced by a grouting spiral anchor is provided and includes a gravity suction anchor, an L-shaped skirt board 6, and a spiral anchor 10.

The gravity suction anchor includes a suction anchor top plate 13 and a wall 1 of a suction anchor barrel body, and uses a concrete press block 4 to reach an estimated set position faster during a penetration stage due to self-weight of the suction anchor. Thereafter, the L-shaped skirt board 6 is lifted to outside of the suction anchor through a skirt board lug 17, and a fixing bolt for the skirt board is used to connect the L-shaped skirt board 6 with the suction anchor. A spiral anchor rod 12 passes through a skirt board hole 7 preformed in the L-shaped skirt board 6 to penetrate to a deep site of seabed, and concrete is grouted through the skirt board hole 7 to a seabed soil area loosened due to penetration of the spiral anchor rod 12, thereby forming a high-strength concrete anti-pulling area after the concrete solidifies. The gravity suction anchor, the spiral anchor rod 12 and a skirting anchor 15 together provide a vertical bearing capacity, a horizontal bearing capacity and an anti-overturning bearing capacity.

Figure 2:
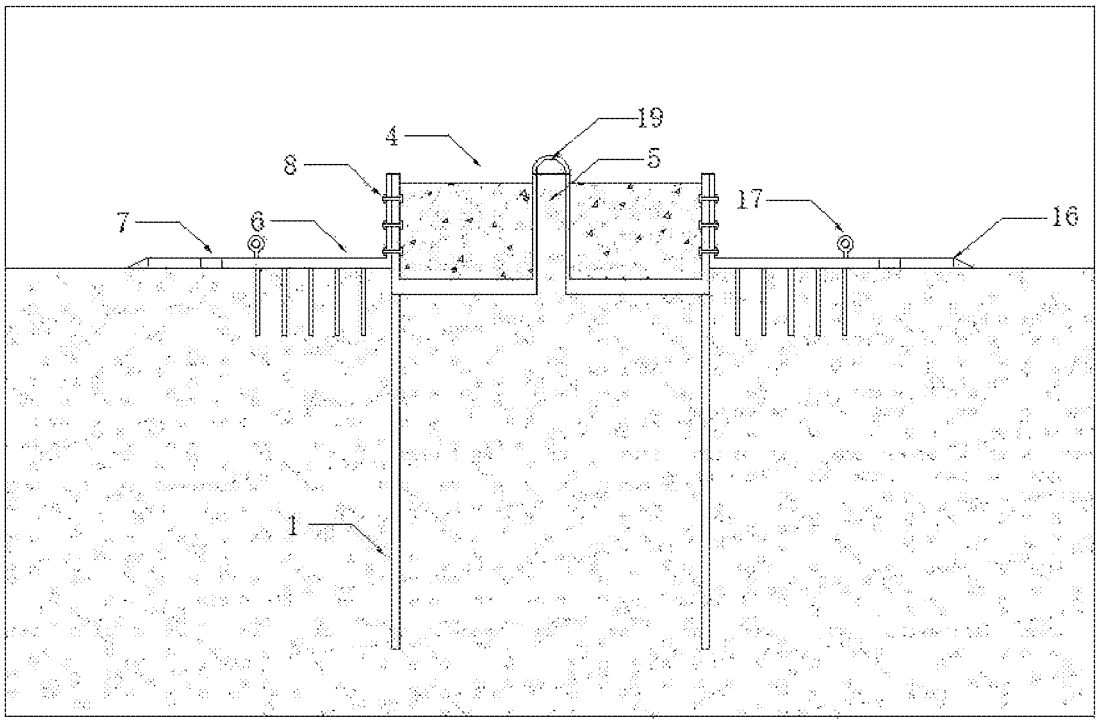
FIG. 2 illustrates a second stage of an installation process of a combined suction anchor of the present disclosure.
Figure 3:
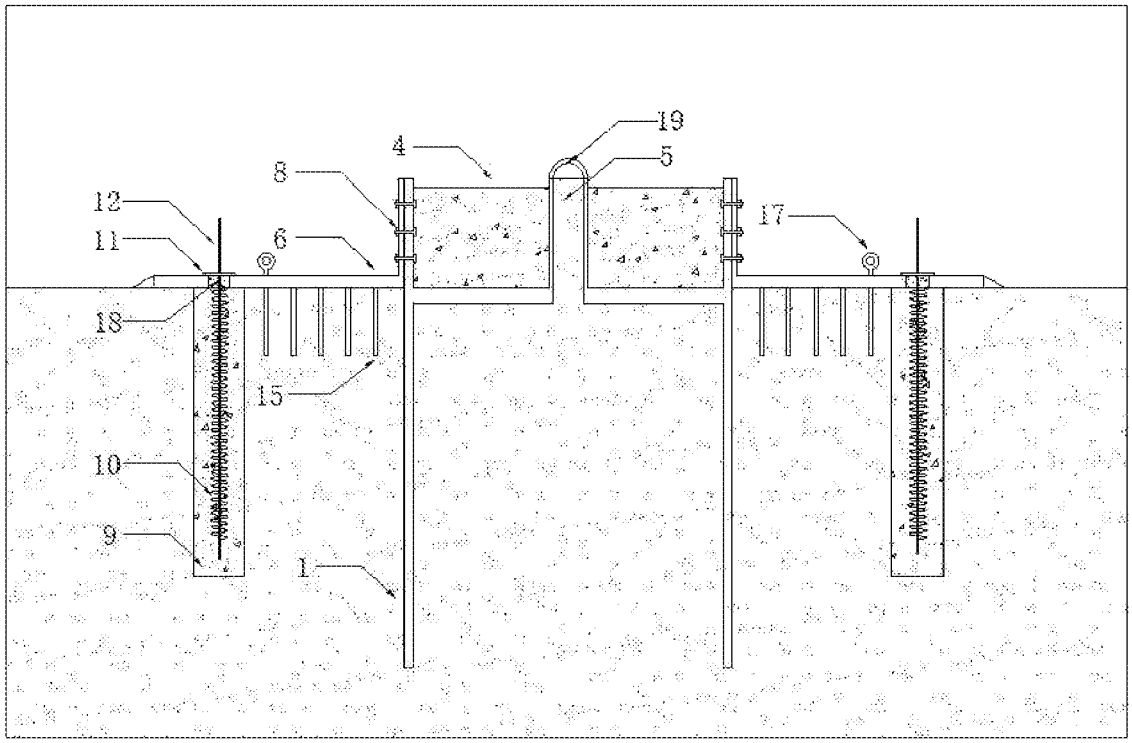
FIG. 3 illustrates a third stage of an installation process of a combined suction anchor of the present disclosure.
Figure 4:
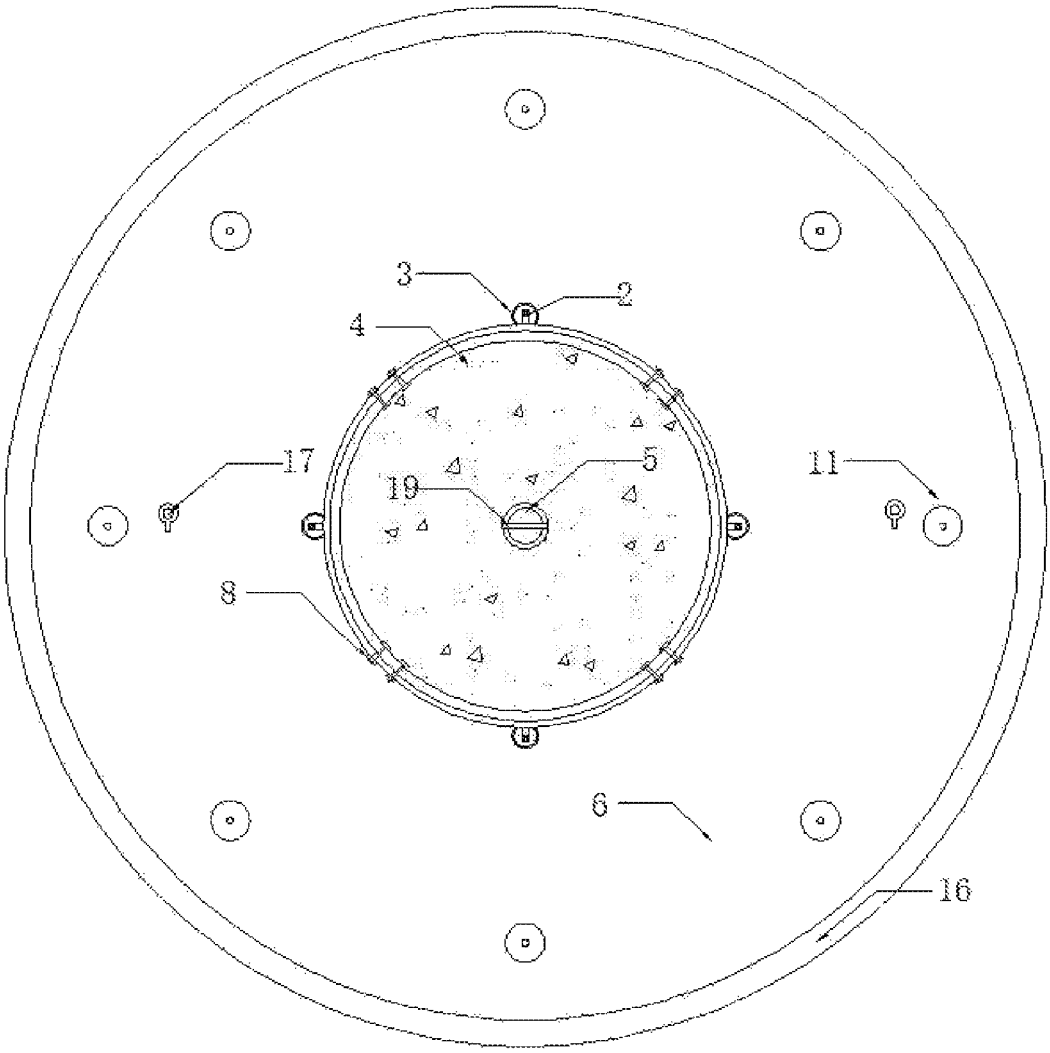
FIG. 4 is a top view of a combined suction anchor of the present disclosure.
Figure 5:
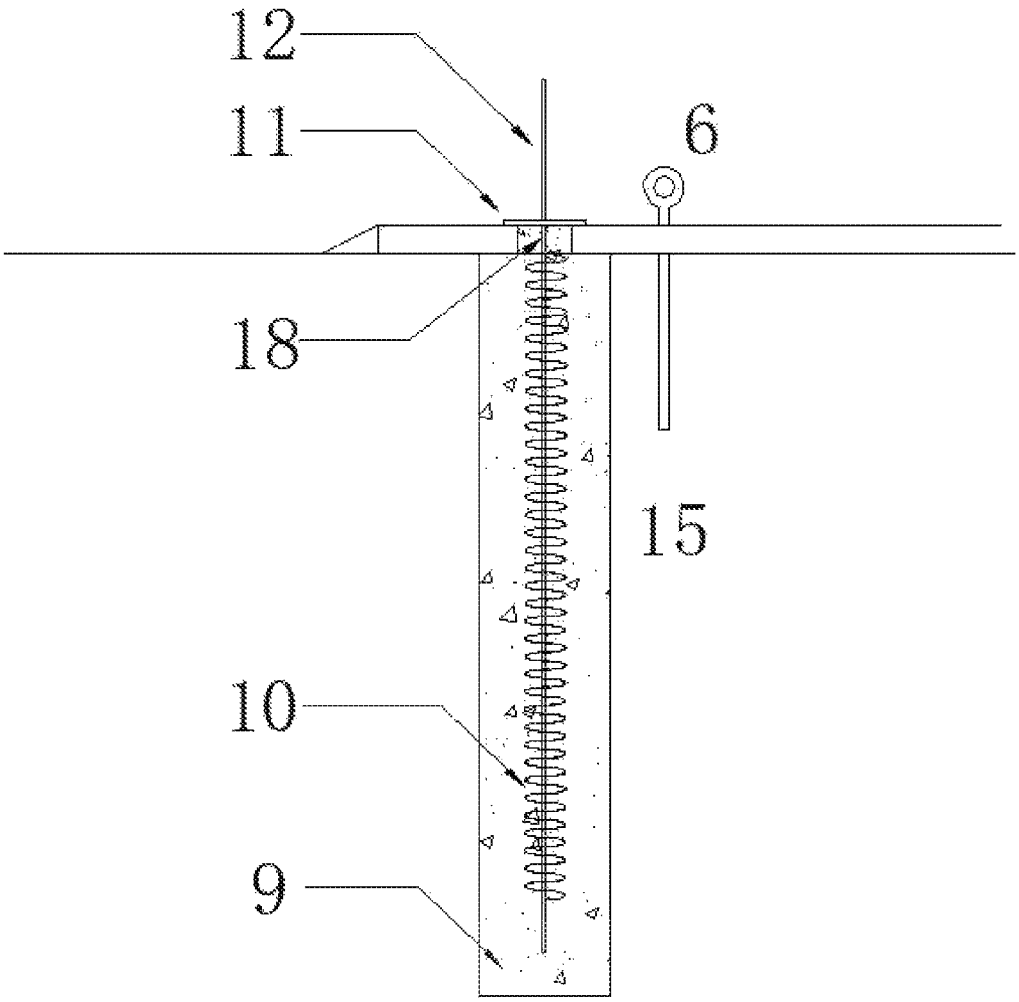
FIG. 5 is a detailed view of a reinforced area of a spiral anchor rod of a combined suction anchor of the present disclosure.

Specifically, as shown in FIG. 1 to FIG. 5, a specific embodiment is illustrated as follows.

An entire installation process of the suction anchor is divided into three stages: a first stage, in which the suction anchor device is installed to a specified depth due to self-weight and suction of the suction anchor; a second stage, in which the L-shaped skirt board 6 is fixed to the suction anchor by a high-strength bolt 8; and a third stage, in which the spiral anchor rod 12 is installed and grouting-fixed to form an anti-pulling reinforced area.

In the first stage of the installation process of the suction anchor, penetration installation is carried out due to self-weight of the suction anchor and the concrete press block 4. Meanwhile, during the installation process, a steel cable hanging a lug 2 vertically passes through a vertical channel 3 to ensure that the suction anchor is always kept vertical during the installation process. Then, a negative pressure is applied through a suction anchor negative pressure hole 5 until the suction anchor reaches a specified installation position.

In the second installation stage of the suction anchor, the annular L-shaped skirt board 6 movably installed by the skirt board lug 17 is sleeved on outside of the wall 1 of the suction anchor barrel body and covers a surface of the seabed. Thereafter, the high-strength bolt 8 is used to make the suction anchor be connected and fixed to the annular L-shaped skirt board 6, thereby improving the vertical bearing capacity and a lateral anti-overturning capacity of the overall suction anchor. The L-shaped skirt board 6 has an end provided with an anti-scouring slope 16, thereby preventing the suction anchor from being subjected to an excessive lateral force during operation. In addition, arrangement of a plurality of rows of the annular skirting anchors 15 can improve the horizontal bearing capacity and the anti-pulling bearing capacity of the suction anchor.

In the third installation stage of the suction anchor, the spiral anchor rod 12 is vertically and rotatably installed through the preformed skirt board hole 7 to penetrate into the seabed soil, until an anti-rotation plate 11 contacts the L-shaped skirt board 6. Then the concrete is grouted through the skirt board hole 7 until the concrete fills an entire grouting area, and the concrete forms a concrete reinforced area 9 in the soil where crack is formed due to penetration of the spiral anchor rod 12, greatly improving the overall anti-pulling bearing capacity of the suction anchor. In addition, the spiral anchor rod 12 and the L-shaped skirt board 6 are connected to each other to form an integrity by consolidation of the concrete poured through the skirt board hole 7.

The suction anchor itself includes two parts: the suction anchor top plate 13 and the wall 1 of the suction anchor barrel body, and these two parts are connected to each other to form an integrity by a connector 14 for the suction anchor top plate and the suction anchor barrel body. There are a total of four connectors 14 for the suction anchor top plate and the suction anchor barrel body, and the four connectors 14 for the suction anchor top plate and the suction anchor barrel body are distributed evenly in a circumferential direction of the suction anchor and each are located below the lug 2 of the suction anchor. There are a total of eight spiral anchors 10 evenly distributed along a circumferential direction of the L-shaped skirt board 6.

The concrete press block 4 is formed by pouring after the entire installation process of the suction anchor top plate 13 and the wall 1 of the suction anchor barrel body are completed, so that the suction anchor can reach the specified position faster during penetration due to self-weight thereof. Meanwhile, the concrete press block 4 can play a role of anti-pulling when the suction anchor is subjected to a vertical pulling force, thereby improving safety performance of the suction anchor during use.

The following takes the suction anchor penetrating into soft clay as an example to briefly describe a specific test process using the device of the above embodiment of the present disclosure.

1. The suction anchor is lifted to a specified installation position through the lug 2, and penetrates into the seabed due to self-weight of the suction anchor and the concrete press block 4, then a negative pressure is applied to an inside of the suction anchor through the suction anchor negative pressure hole 5, thereby installing the suction anchor to a specified depth.
2. The L-shaped skirt board 6 is installed to the outside of the suction anchor, and the suction anchor is fixed and connected to the L-shaped skirt board 6 by the high-strength bolt 8.
3. The spiral anchor rod passes through the skirt board hole 7 preformed in the L-shaped skirt board 6, and is rotatably installed into the seabed soil until the anti-rotation plate 11 contacts the L-shaped skirt board 6. During the penetration process, the spiral anchor rod remains vertical.
4. The concrete is poured, through the skirt board hole 7, into an area formed during insertion of the spiral anchor rod 12, such that the spiral anchor rod 12 and the L-shaped skirt board 6 are fixed to form an overall suction anchor, and the concrete reinforced area 9 is formed after curing, together bearing an external force.

What is claimed is:

1. A combined suction anchor reinforced by a grouting spiral anchor, comprising a gravity suction anchor, an L-shaped skirt board and a spiral anchor;

wherein the gravity suction anchor is closed at an upper end and open at a lower end and comprises a suction anchor top plate and a wall of a suction anchor barrel body, a groove is formed between the wall of the suction anchor barrel body and the suction anchor top plate, and a concrete press block is provided in the groove; and the suction anchor top plate is further provided with a suction anchor negative pressure hole, and a suction anchor eye is provided at an upper end of the suction anchor negative pressure hole;

the L-shaped skirt board has an annular shape and is provided with skirt board lugs that are symmetrically arranged at an upper part of the L-shaped skirt board, the skirt board lugs are configured to lift the L-shaped skirt board to outside of the suction anchor to be connected to the suction anchor, and a plurality of rows of skirting anchors are provided at a lower part of the L-shaped skirt board, so as to improve a horizontal bearing capacity and an anti-pulling bearing capacity of the suction anchor; and the spiral anchor comprises a spiral anchor rod and an anti-rotation plate provided at an top end of the spiral anchor rod, the spiral anchor rod is vertically and rotatably installed into seabed soil through a skirt board hole formed in the L-shaped skirt board, until the anti-rotation plate contacts the L-shaped skirt board, and concrete is poured through the skirt board hole to form a concrete reinforced area.

2. The combined suction anchor reinforced by the grouting spiral anchor according to claim 1, wherein the suction anchor top plate is further provided with a lug, above which a vertical channel is provide in such a manner that the suction anchor always keeps vertical during an installation process.

3. The combined suction anchor reinforced by the grouting spiral anchor according to claim 2, wherein four connectors for the suction anchor barrel body and the suction anchor top plate are provided, and are evenly distributed in a circumferential direction of the suction anchor and located below the lug.

4. The combined suction anchor reinforced by the grouting spiral anchor according to claim 1, wherein the suction anchor and the L-shaped skirt board are fixedly connected to each other by a high-strength bolt, and the high-strength bolt has a bolt performance grade greater than or equal to a grade of 9.8.

5. The combined suction anchor reinforced by the grouting spiral anchor according to claim 1, wherein an anti-scouring slope is provided at an end of the L-shaped skirt board.

6. The combined suction anchor reinforced by the grouting spiral anchor according to claim 1, wherein the concrete press block is formed by pouring after an entire installation process of the suction anchor top plate and the wall of the suction anchor barrel body are completed, and is configured to allow the suction anchor to reach a specified position faster during penetration of the suction anchor due to self-weight thereof.

7. The combined suction anchor reinforced by the grouting spiral anchor according to claim 1, wherein eight spiral anchors are provided, and the eight spiral anchors are evenly distributed along a circumferential direction of the L-shaped skirt board.

* * * * *